US008342621B2

(12) United States Patent
Saiga et al.

(10) Patent No.: US 8,342,621 B2
(45) Date of Patent: Jan. 1, 2013

(54) IMAGE FORMING APPARATUS

(75) Inventors: Soichi Saiga, Tokyo (JP); Ichiro Komuro, Kanagawa (JP); Shinichiro Naruse, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 399 days.

(21) Appl. No.: 12/627,086

(22) Filed: Nov. 30, 2009

(65) Prior Publication Data

US 2010/0231643 A1 Sep. 16, 2010

(30) Foreign Application Priority Data

Mar. 12, 2009 (JP) ..... 2009-058952

(51) Int. Cl.
*B41J 25/308* (2006.01)

(52) U.S. Cl. ..... 347/8; 347/5

(58) Field of Classification Search ..... None
See application file for complete search history.

(56) References Cited

U.S. PATENT DOCUMENTS

| | | | |
|---|---|---|---|
| 7,431,422 | B2 | 10/2008 | Asanuma et al. |
| 7,481,507 | B2 | 1/2009 | Naruse |
| 2005/0002714 | A1 | 1/2005 | Tsuji |

FOREIGN PATENT DOCUMENTS

| | | | |
|---|---|---|---|
| CN | 1550350 | A | 12/2004 |
| CN | 2663145 | Y | 12/2004 |
| JP | 3617626 | | 11/2004 |
| JP | 2005-271531 | | 10/2005 |
| JP | 2007-152792 | | 6/2007 |
| JP | 2007-223232 | | 9/2007 |

OTHER PUBLICATIONS

Oct. 10, 2011 Chinese official action in connection with a counterpart Chinese patent application (with English translation).

*Primary Examiner* — Matthew Luu
*Assistant Examiner* — Justin Seo
(74) *Attorney, Agent, or Firm* — Cooper & Dunham LLP

(57) ABSTRACT

An image forming apparatus includes a base member where a plurality of recording heads is provided, the recording heads being configured to jet liquid drops onto a recording medium; a carriage configured to elevatably support the base member; and an elevating part configured to elevate the base member relative to the carriage, wherein the elevating part is a plurality of slide cam members provided movably in a horizontal direction.

8 Claims, 9 Drawing Sheets

IMAGE FORMING APPARATUS

CROSS-REFERENCE TO RELATED APPLICATIONS

This patent application is based upon and claims the benefit of priority of Japanese Patent Application No. 2009-58952 filed on Mar. 12, 2009 the entire contents of which are incorporated herein by reference.

BACKGROUND OF THE INVENTION

1. Field of the Invention

The present invention generally relates to image forming apparatuses. More specifically, the present invention relates to an image forming apparatus including a carriage with a recording head configured to eject liquid drops.

2. Description of the Related Art

As an image forming apparatus such as a printer, facsimile machine, copier, plotter, or a multiple function processing machine including the printer, facsimile machine, copier, and the plotter, an inkjet recording apparatus is known. The inkjet recording apparatus is a liquid jet recording type image forming apparatus using a recording head configured to jet ink liquid drops.

In this liquid jet recording type image forming apparatus, the ink liquid drops are jetted from the recording head onto a conveyed sheet so that image forming such as recording or printing is performed. In the liquid jet recording type image forming apparatus, there are two kinds of image forming apparatuses. One is a serial type image forming apparatus configured to jet liquid drops so that an image is formed while a recording head moves in a main scanning direction. The other is a line type image forming apparatus using a line type head whereby liquid drops are jetted while the recording head does not move so that an image is formed.

Hereinafter, the "image forming apparatus" means an apparatus configured to jet liquid onto a medium such as a paper, thread, fiber, leather, hides, metal, plastic, glass, wood, or ceramic so that images are formed. The image forming apparatus includes a mere liquid jetting apparatus. In addition, "image forming" means not only providing an image of characters, figures, or the like on the medium but also providing an image such as a pattern having no meaning on the medium. "Image forming" includes adherence of the liquid drops onto the medium.

Furthermore, "ink" is not limited to the recording liquid or the ink and any liquid that is a fluid when being jetted can be applied as the liquid such as fixing liquid. In addition, "sheet" is not limited to a paper but includes an OHP sheet or leather. In other words, the sheet means a subject where the ink drop is adhered. The sheet includes a recorded medium, a recording medium, a recording paper, and a recording sheet.

In the serial type inkjet recording apparatus, a carriage having a recording head is slidably held by primary and secondary guide members. The carriage is moved in a main scanning direction by a main scanning moving mechanism such as a driving motor, a timing belt and a pulley.

In such an inkjet recording apparatus, it is necessary to keep a distance (gap) between the sheet and a nozzle surface of the recording head constant. If the gap is not constant, positional precision of adherence of the liquid drop onto the medium is degraded by, for example, reciprocating printing. In addition, since the thickness of the sheet is not always constant depending on kinds of the sheet, it is necessary to adjust the gap between the sheet and the nozzle surface of the recording head.

Because of this, a structure where a gap adjusting mechanism is provided has been known conventionally. As the gap adjusting mechanism, for example, i) a structure where a height position of the carriage is changed by elevating a frame and a guide member movably holding the carriage, ii) a structure where a height position of the carriage is changed by elevating a guide member of the carriage, iii) a structure where a conveyance belt configured to convey the sheet elevates, iv) a structure where a platen member facing the recording head and configured to guide the sheet elevates, or the like has been suggested.

In addition, the following structure has been also suggested. Plural shafts, a power transmitting member, and a rotating member are provided on a carriage. Each of the plural shafts has the same configuration where a part for providing a head holder holding the recording head is eccentric. The power transmitting member is provided between the plural shafts and configured to transmit a driving force. The driving part is configured to rotate the eccentric shaft. The plural shafts are arranged in parallel with each other. By rotating the rotating part, the plural shafts are rotated at the same angle so that the head holder goes upward and downward.

As shown in Japanese Laid-Open Patent Application Publication No. 2007-223232 and Japanese Laid-Open Patent Application Publication No. 2007-152792, a structure where the carriage is elevated for every main scanning guide member or the frame so that the gap between the recording head and the sheet conveyance surface is adjusted, is proper for a small sized inkjet recording apparatus.

However, in a recording apparatus for forming an image on a so-called large size and wide width medium, since the length in the main scanning direction is greater than 1000 mm and equal to or greater than 1500 mm, the weight of the entire carriage including the main scanning guide member or the frame and the carriage is equal to or greater than 10 kgf. Hence, it is difficult to elevate the carriage for every main scanning guide member or the frame with high precision.

The following structure has been suggested in Japanese Patent No. 3617626. The head holder configured to hold the recording head can be elevated relative to the carriage. The head holder hangs at the slider due to an energizing force of the spring. By using the cam mechanism, the head holder is elevated relative to the slider. With this structure, although the weight of a part which is elevated can be made light, if the number of the heads provided at the carriage is increased, the weight of the head holder is increased. Hence, it is difficult to stably hold the head.

The following structure has been suggested in Japanese Patent Application Publication No. 2005-271531. The holder configured to hold the head is provided in the carriage. The holder is provided on plural eccentric cams provided in parallel in the carriage. The eccentric cams are simultaneously rotated at the same angle so that the head with the holder is elevated. In this structure, if the number of the heads is increased, the weight of the head holder is increased. Hence, it is necessary to increase a diameter of the shaft of the eccentric cam. If the diameter of the shaft of the eccentric cam becomes larger, the width of the carriage becomes larger so that it is difficult to perform the driving control of the carriage. In addition, the width of the carriage becomes large so that the size of the apparatus becomes large.

SUMMARY OF THE INVENTION

Accordingly, embodiments of the present invention may provide a novel and useful image forming apparatus solving one or more of the problems discussed above.

More specifically, the embodiments of the present invention may provide an image forming apparatus whereby plural recording heads can be held so as to be stably elevated relative to the carriage without making the size of the carriage large.

One aspect of the embodiments of the present invention may be to provide an image forming apparatus, including a base member where a plurality of recording heads is provided, the recording heads being configured to jet liquid drops onto a recording medium; a carriage configured to elevatably support the base member; and an elevating part configured to elevate the base member relative to the carriage, wherein the elevating part is a plurality of slide cam members provided movably in a horizontal direction.

According to the image forming apparatus of the embodiments of the present invention, the base member where the plural recording heads are provided is elevated by plural slide cam members provided movably in the horizontal direction. Therefore plural recording heads can be held so as to be elevated and stable relative to the carriage without making the size of the carriage large.

Additional objects and advantages of the embodiments will be set forth in part in the description which follows, and in part will be obvious from the description, or may be learned by practice of the invention. The object and advantages of the invention will be realized and attained by means of the elements and combinations particularly pointed out in the appended claims.

It is to be understood that both the foregoing general description and the following detailed description are exemplary and explanatory only and are not restrictive of the invention as claimed.

DETAILED DESCRIPTION OF THE PREFERRED EMBODIMENTS

A description is given below, with reference to the FIG. 1 through FIG. 12 of embodiments of the present invention.

Figure 1:
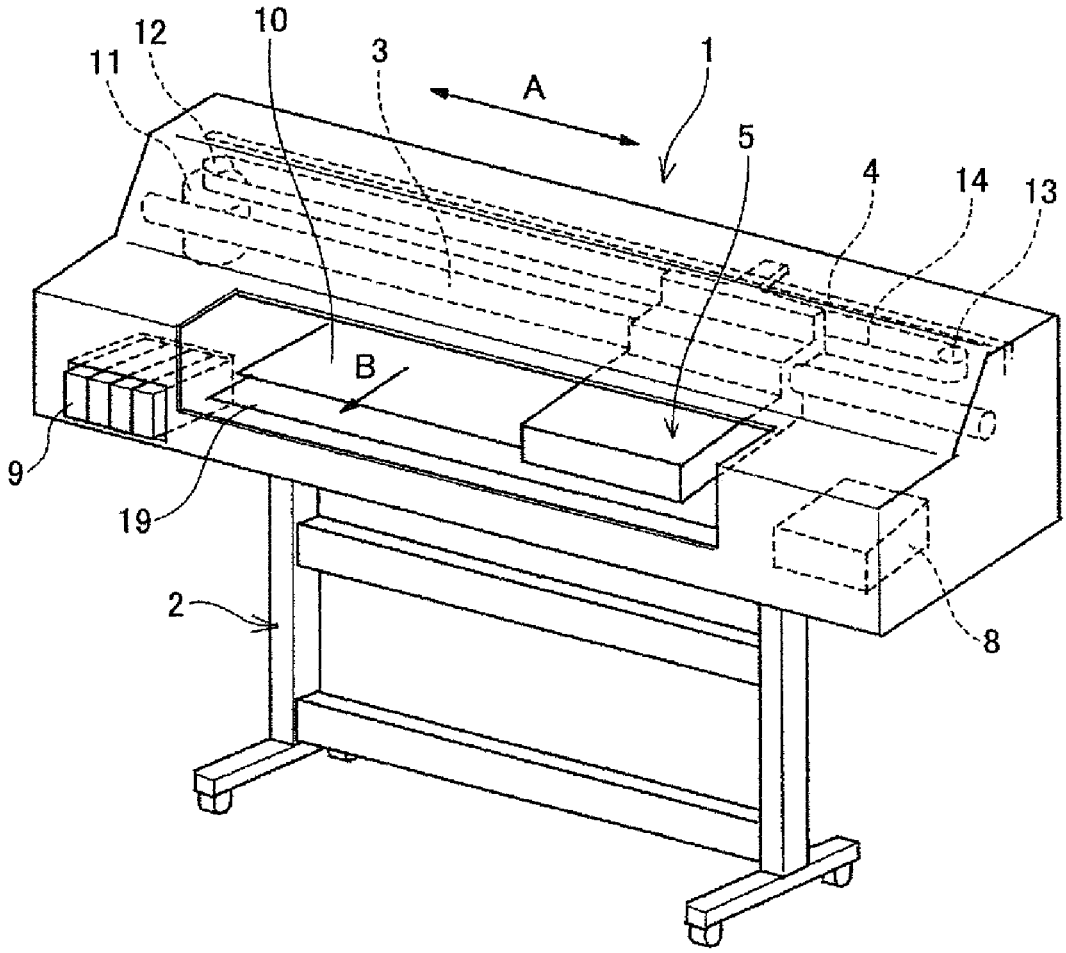
FIG. 1 is a perspective view of an entire structure of an inkjet recording apparatus as an image forming apparatus of an embodiment of the present invention.
Figure 2:
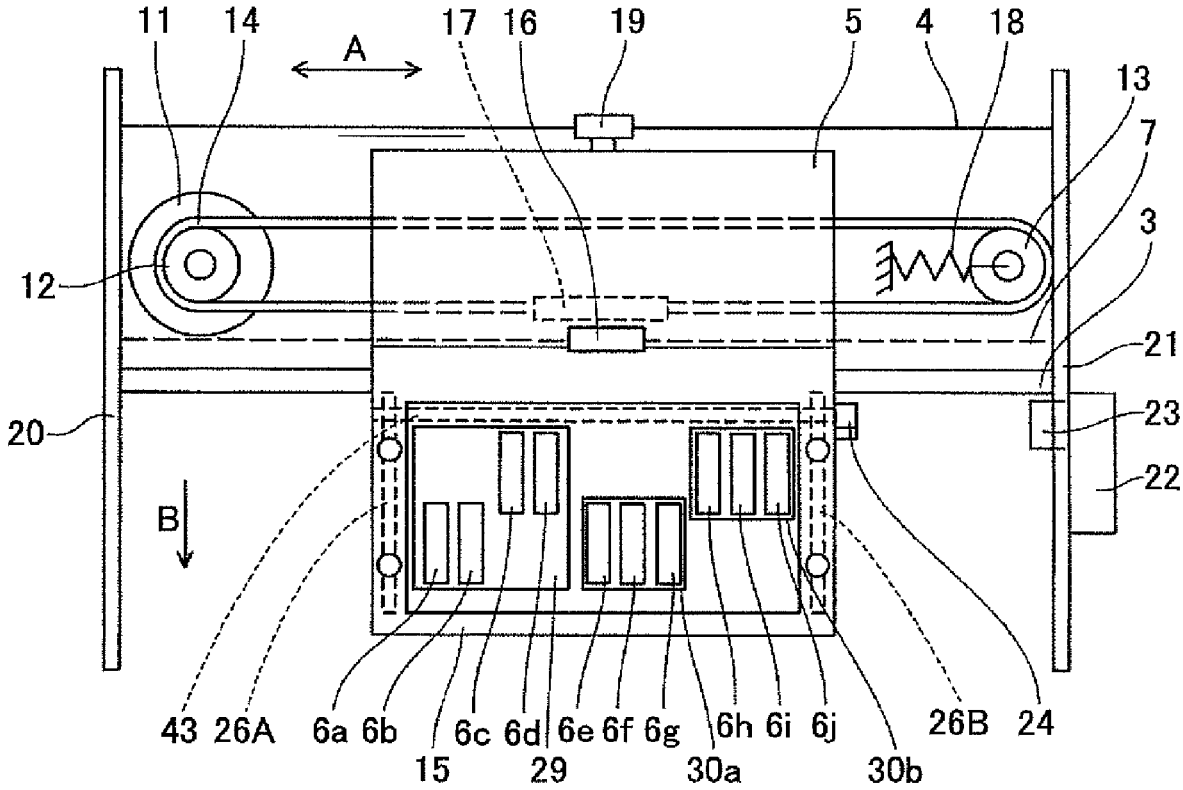
FIG. 2 is a schematic plan view of a mechanism part of the inkjet recording apparatus of the embodiment of the present invention.
Figure 3:
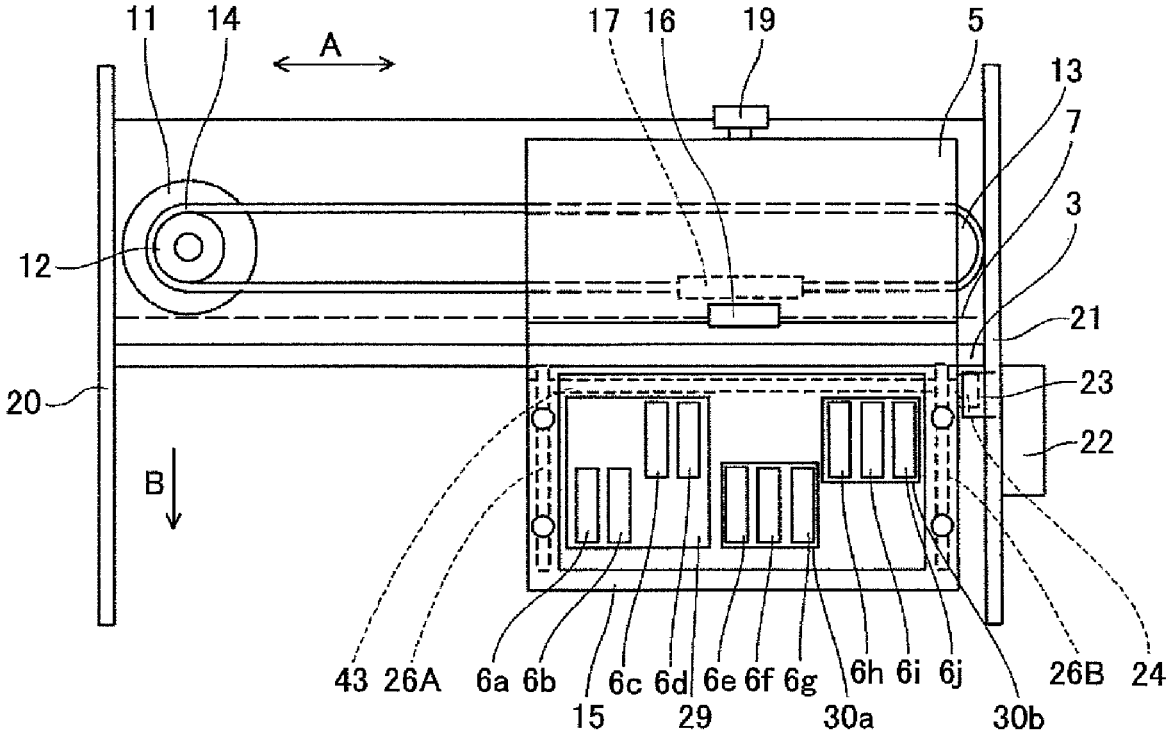
FIG. 3 is a schematic plan view of the mechanism part of the inkjet recording apparatus of the embodiment of the present invention in a home position state.

First, an inkjet recording apparatus as an image forming apparatus of the embodiment of the present invention is discussed with reference to FIG. 1 through FIG. 3. Here, FIG. 1 is a perspective view of an entire structure of the inkjet recording apparatus as an image forming apparatus of an embodiment of the present invention. FIG. 2 is a schematic plan view of a mechanism part of the inkjet recording apparatus of the embodiment of the present invention. FIG. 3 is a schematic plan view of the mechanism part of the inkjet recording apparatus of the embodiment of the present invention in a home position.

This inkjet recording apparatus is a serial type inkjet recording apparatus that includes a recording apparatus main unit 1 and a supporting base 2 configured to support the recording apparatus main unit 1.

A guide rod 3 and a guide rail 4 are provided between side plates 20 and 21 inside the recording apparatus main unit 1. A carriage 5 is held at the guide rod 3 and the guide rail 4 so as to be slidable in a main scanning direction indicated by an arrow A. The guide rail 4 is sandwiched by rollers 19 (19*a*, 19*a*) provided at a rear surface side of the carriage 5.

As shown in FIG. 2, ten recording heads 6*a* through 6*j* are provided in the carriage 5. The recording heads 6*a* through 6*j* are formed by liquid jet heads configured to jet ink drops of black (K), yellow (Y), magenta (M), and cyan (C). The recording heads 6 of each color are positioned so as to be shifted in the main scanning direction and a direction crossing the main scanning direction (sheet sending direction; sub-scanning direction) relative to each other. In addition, a sub-tank is provided at each of the recording heads 6 so as to supply the ink to the corresponding recording head 6.

A main scanning mechanism configured to move the carriage 5 in the main scanning direction includes a driving motor 11, a driving pulley 12, an idler pulley 13, and a belt member 14. The driving motor 11 is arranged at one side in the main scanning direction. The driving pulley 12 is rotated by the driving motor 11. The idler pulley 13 is arranged at another side in the main scanning direction. The belt member 14 is provided between and hung around the driving pulley 12 and the idler pulley 13. Tension is applied to the belt member 14 by a pressing spring 18 applying a force outward (in a direction away from the driving pulley 12) on the idler pulley 13.

The driving pulley 12 and the idler pulley 13 are arranged so that pulley shaft axial directions of the driving pulley 12 and the idler pulley 13 are along an ink drop jetting direction. The belt member 14 is provided between and hung around the driving pulley 12 and the idler pulley 13. A part of the belt member 14 is fixed and held at a belt fixing part 17 provided at a rear surface side of the carriage 5 so that the belt member 14 is arranged at one side of the carriage 5 in a direction perpendicular to the main scanning direction.

In addition, a linear scale 7 is arranged along the main scanning direction of the carriage 5. The linear scale 7 is configured to detect a main scanning position of the carriage 5. The linear scale 7 is read by an encoder sensor 16 provided at the carriage 5.

In a recording area in a main scanning area of the carriage 5, a sheet 10 is intermittently conveyed in a sub-scanning direction (an arrow B direction) perpendicular to the main scanning direction of the carriage 5 by a sheet sending mechanism (not shown). In addition, a maintaining and recovering mechanism 8 configured to perform maintaining and recovering of the recording heads 6 is provided in one of end side areas of the main scanning area. Furthermore, an ink cartridge 9 is detachably provided relative to the recording apparatus main unit 1, outside a carriage moving area in the main scanning direction or below another end part side of the carriage moving area. The ink cartridge 9 is configured to store and supply each color ink to the corresponding sub-tanks of the recording head 6.

In this inkjet recording apparatus, while the carriage 5 is moved in the main scanning direction and the sheet 10 is intermittently sent in the sub-scanning direction, the recording heads 6 are driven based on the image information so that the liquid drops are jetted, and thereby the image is formed on the sheet 10.

Here, a head base 15 is provided in the carriage 5 so as to move upward and downward (elevate). The head base 15 is a base member configured to hold the ten recording heads 6. Hence, it is possible to adjust (control) a gap between an ink drop jetting part (nozzle surface) of the recording heads 6 and a surface of the sheet 10 as a recording medium to be a proper distance.

Figure 4:
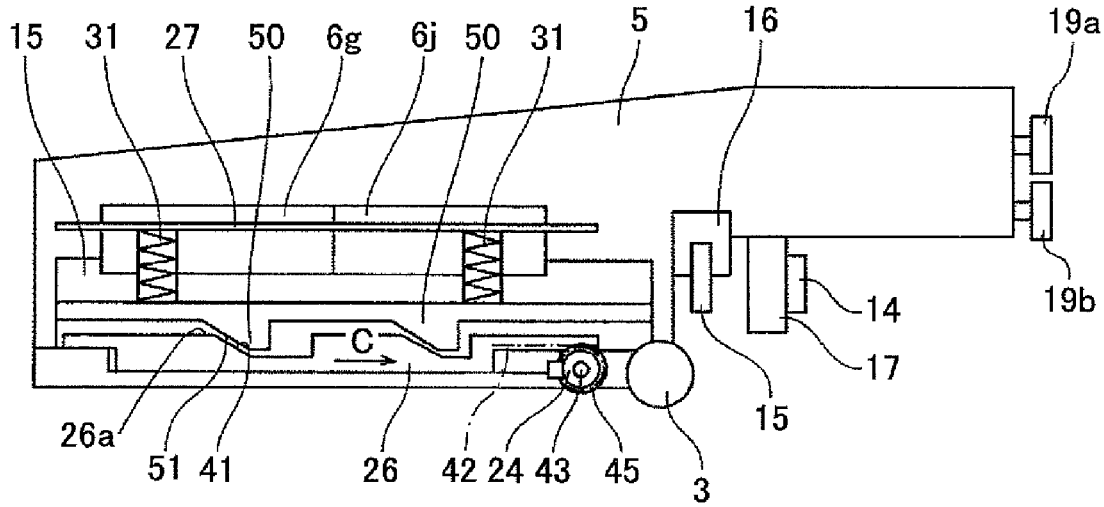
FIG. 4 is a schematic side view of a head elevating mechanism when a head goes downward.
Figure 5:
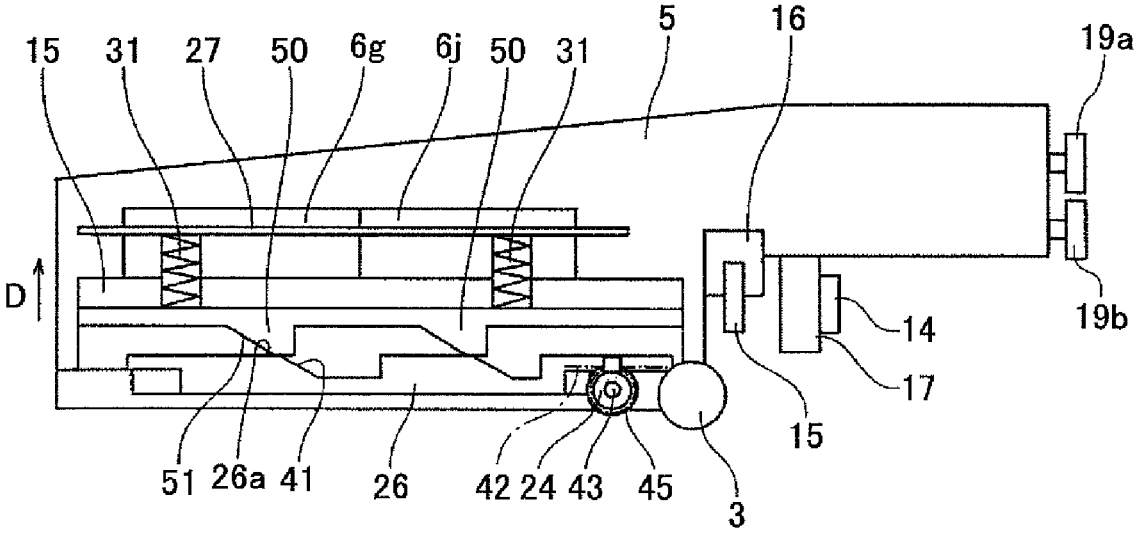
FIG. 5 is a schematic side view of the head elevating mechanism when the head goes upward.
Figure 6:
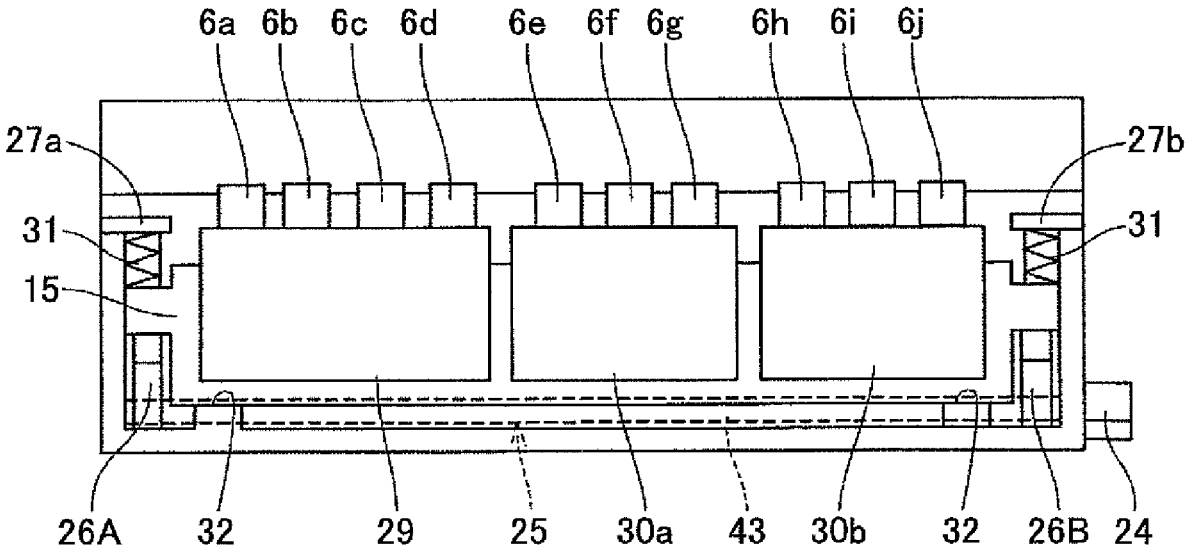
FIG. 6 is a front view of the head elevating mechanism.
Figure 7:
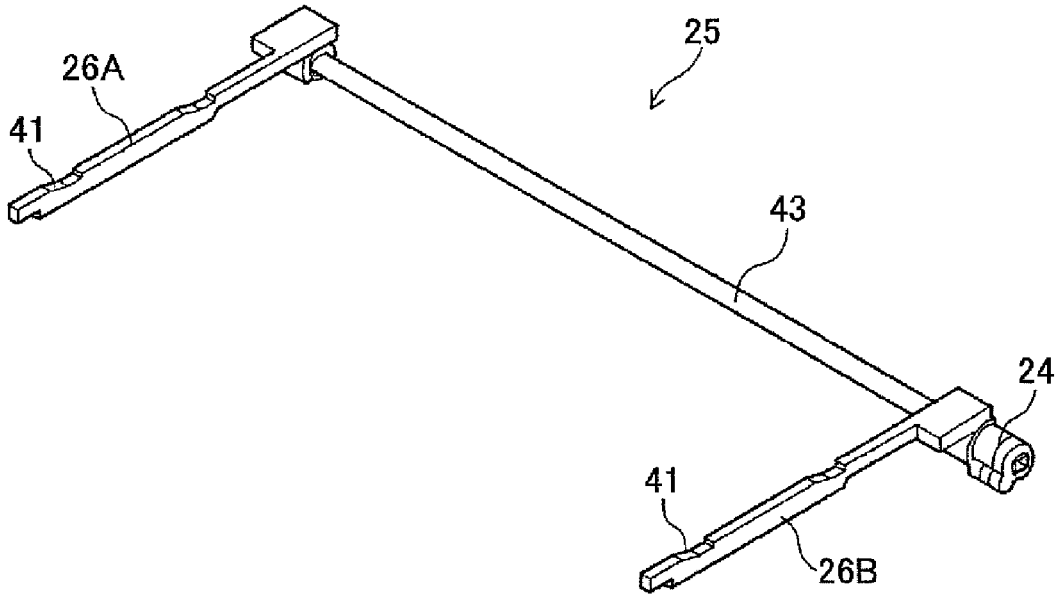
FIG. 7 is a perspective view of a driving transmitting part of the head elevating mechanism.
Figure 8:
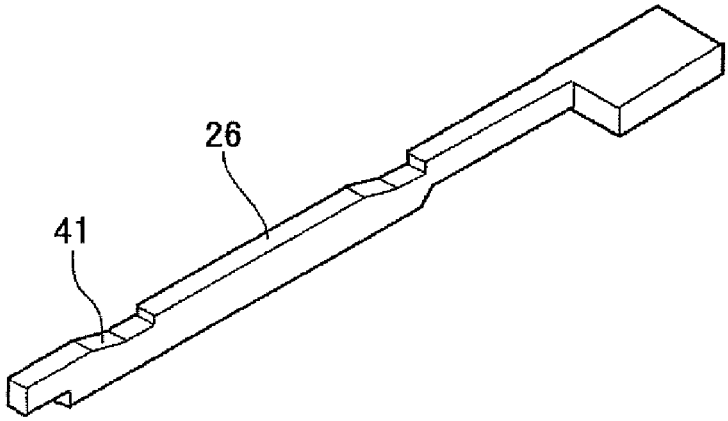
FIG. 8 is a perspective view of a slide cam member of the head elevating mechanism.
Figure 9:
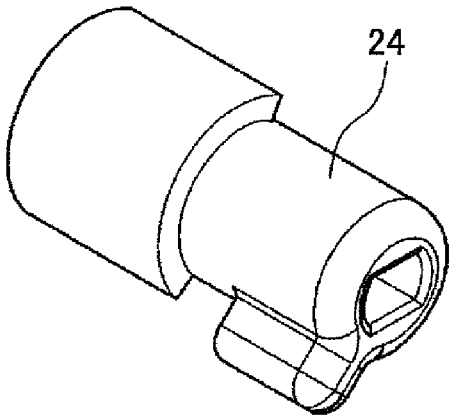
FIG. 9 is a perspective view of a joint member of the head elevating mechanism.
Figure 10:
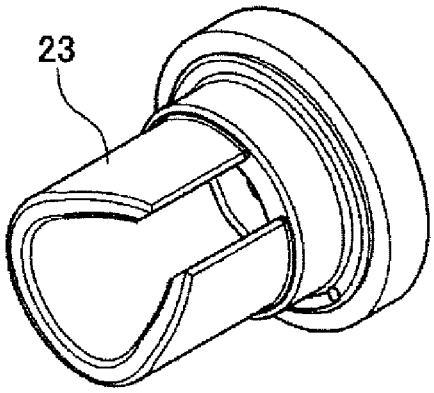
FIG. 10 is a perspective view of a coupling member of the head elevating mechanism.

A head elevating mechanism (gap adjusting mechanism) is discussed with reference to FIG. 4 through FIG. 10. FIG. 4 is a schematic side view of a head elevating mechanism when the heads 6 go downward. FIG. 5 is a schematic side view of the head elevating mechanism when the heads 6 go upward. FIG. 6 is a front view of the head elevating mechanism. FIG. 7 is a perspective view of a driving transmitting part of the head elevating mechanism. FIG. 8 is a perspective view of a slide cam member of the head elevating mechanism. FIG. 9 is a perspective view of a joint member of the head elevating mechanism. FIG. 10 is a perspective view of a coupling member of the head elevating mechanism.

In the carriage 5, the head base 15 is elevatably provided. A head unit 29, a head unit 30*a*, and a head unit 30*b* are provided on the head base 15. In the head unit 29, the recording heads 6*a* and 6*b* and the recording head 6*c* and 6*d* configured to jet black color liquid drops are positioned so as to be shifted relative to each other at one head recording area in the sub-scanning direction. The recording heads 6*e*, 6*f*, and 6*g* where nozzle lines configured to jet liquid drops of yellow, magenta, and cyan colors are arranged in a symmetrical manner are arranged in the head unit 30*a*. The recording heads 6*h*, 6*i*, and 6*j* where nozzle lines configured to jet liquid drops of yellow, magenta, and cyan colors are arranged in a symmetrical manner are arranged in the head unit 30*b*. The head units 30*a* and 30*b* are arranged so as to be shifted relative to each other at one head recording area in the sub-scanning direction.

At both end parts of the carriage 5 in a main scanning direction, corresponding slide cams 26 (26A, 26B) are arranged so as to move in the sheet sending direction (sub-scanning direction) as the elevating part configured to elevate the head base 15. In addition, the head base 15 is provided on the slide cams 26. The head base 15 is pushed to the slide cams 26 by pressing springs 31 provided between the head base 15 and fixing parts 27*a* and 27*b* provided at the carriage 5, so that movement and vibration of the head base 15 inside the carriage 5 is prevented when the carriage 5 is moved.

In a wide recording apparatus, as shown in FIG. 1, since the size of the recording sheet is large, the length of the carriage (width of the apparatus) in the main scanning direction is extremely large. Therefore, there is demand for shortening the width in the main scanning direction as much as possible. The width of the apparatus is defined by the sum of a recording area width (sheet size) and a width of the carriage in the main scanning direction (in a case where a maintenance area is provided at both ends of the recording area, the sum of the width of the recording area and two widths of the carriage in the main scanning direction). Accordingly, it is preferable that the width of the carriage in the main scanning direction be as small as possible. Accordingly, by making the moving direction of the slide cam 26 be the sub-scanning direction, the increase of the width of the carriage 5 in the main scanning direction due to providing the elevating mechanism in the carriage 5 can be limited to the thickness of the slide cams 26. Hence, it is possible to restrain the increase of the width of the entire apparatus in the main scanning direction.

Cam surfaces 41 and 41 and a positioning part 26*a* are formed in the slide cam 26. At a lower surface of the head base 15, projection parts 50 and 50 having tilt surfaces 51 and 51 are formed. The tilt surfaces 51 and 51 are engaged with the corresponding cam surfaces 41 of the slide cams 26. The slide cams 26 are moved in a direction indicated by an arrow C in FIG. 4. As shown in FIG. 5, the cam surfaces 41 come in contact with the corresponding inclination surfaces 51 so that the entire head base 15 is pushed up and thereby the projection part 50 is mounted on the positioning parts 26*a*. As a result of this, the gap between the sheet 10 and the nozzle surfaces of the recording heads 6 of the head base 15 can be adjusted.

A rack 42 is formed in the slide cam 26 in order to move the slide cam 26. On the other hand, at the carriage 5 side, a driving force transmitting part 25 is provided to provide a driving force at both end parts of a shaft 43 provided in the main scanning direction. Pinions 45 configured to mesh with the racks 42 are provided at the driving force transmitting part 25. The slide cams 26A and 263 provided one at each end part of the head base 15 can be simultaneously moved at the same distance so as to be elevated while the head base 15 remains horizontal.

The driving part 25 configured to move the slide cams 26 is provided outside the carriage 5. The carriage 5 is moved to the home position or a designated position so that a joint member 24 provided at the driving force transmitting part 25 provided in the carriage 5 is connected to a coupling member 23 provided at the driving part 25 provided at the right side plate 21. Because of this, the driving force is transmitted to the slide cams 26 via the driving force transmitting part 25 and thereby the head base 15 can be elevated. Thus, the driving part 25 is provided outside the carriage 5 and the head base 15 is elevated by a stand type mechanism so that the increase of weight and volume of the carriage 5 can be restrained.

In addition, as shown in FIG. 6, in the carriage 5, a positioning part 32 is provided. The bottom surface of the head base 15 comes directly in contact with the positioning part 32 in a position where the head base 15 goes down most without using the elevating mechanism. Hence the error of the printing gap between the recording head 6 and the surface of the sheet 10 can be made smaller than that at the time when the head base 15 goes up.

Thus, in this embodiment, the base member where plural recording heads are provided is elevated by plural slide cam members provided movably in the horizontal direction. Hence, it is possible to hold plural recording heads so that the recording heads can be stably elevated relative to the carriage. Therefore, it is possible to elevate the recording heads without making the size of the carriage large.

Figure 11:
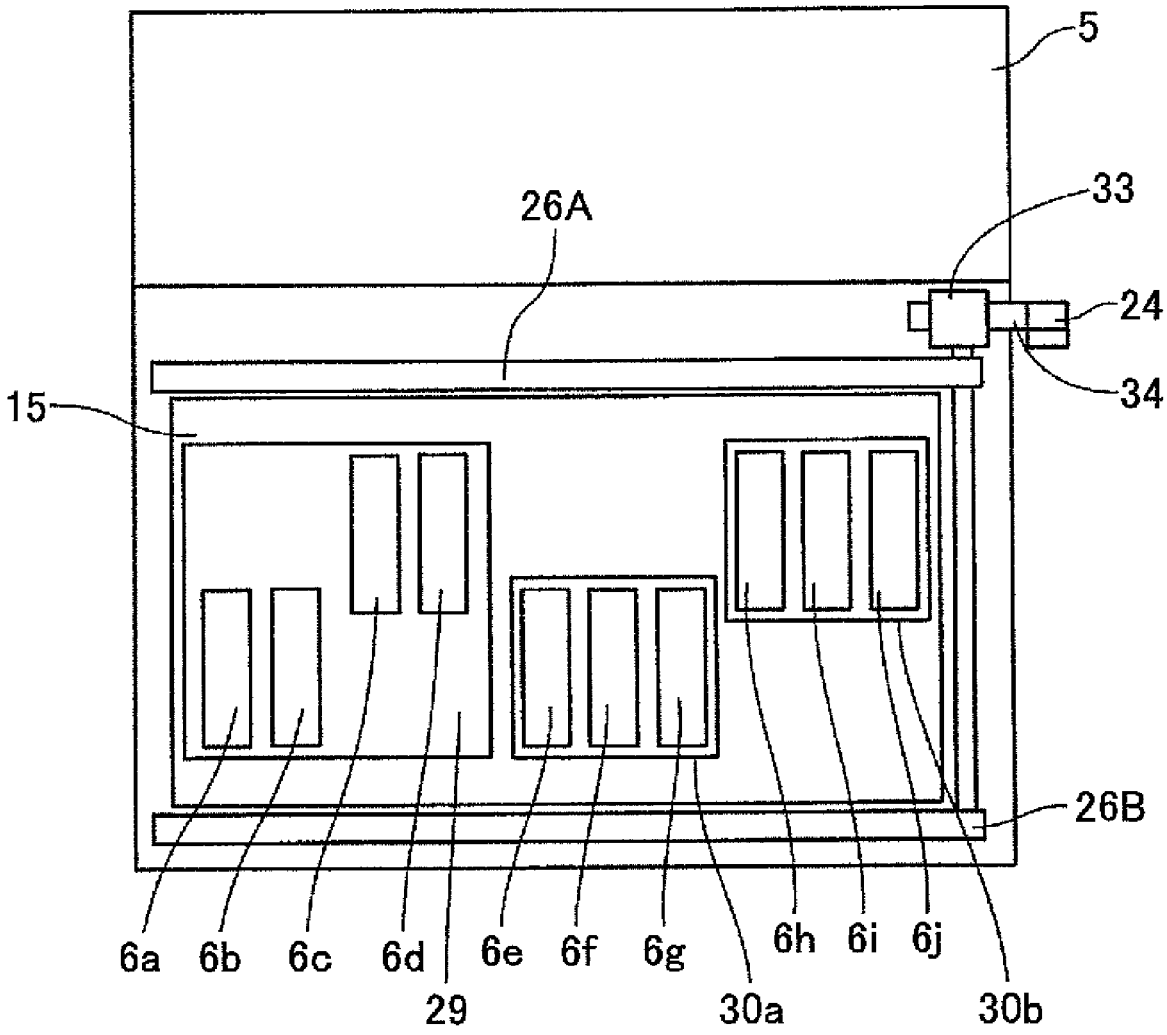
FIG. 11 is a partial plan view for explaining another embodiment of the present invention.

Next, another embodiment of the present invention is discussed with reference to FIG. 11. FIG. 11 is a partial plan view for explaining another embodiment of the present invention.

In this embodiment, a moving direction of the slide cam 26 is a main scanning direction. In this case, an increase of the width of the carriage 5 in the sub-scanning direction by providing the elevating mechanism in the carriage 5 can be limited to the thickness of the slide cams 26. Accordingly, it is possible to restrain the increase of the width of the entire apparatus in the sub-scanning direction.

For example, a worm gear 34 and a worm wheel 33 are used as a driving force transmitting part configured to move the slide cam 26 in the main scanning direction. In addition, in this embodiment, as well as the first embodiment, the slide cam 26 can be moved by a driving part arranged outside the carriage 5 where the carriage 5 is moved to the home position or a designated position.

Figure 12:
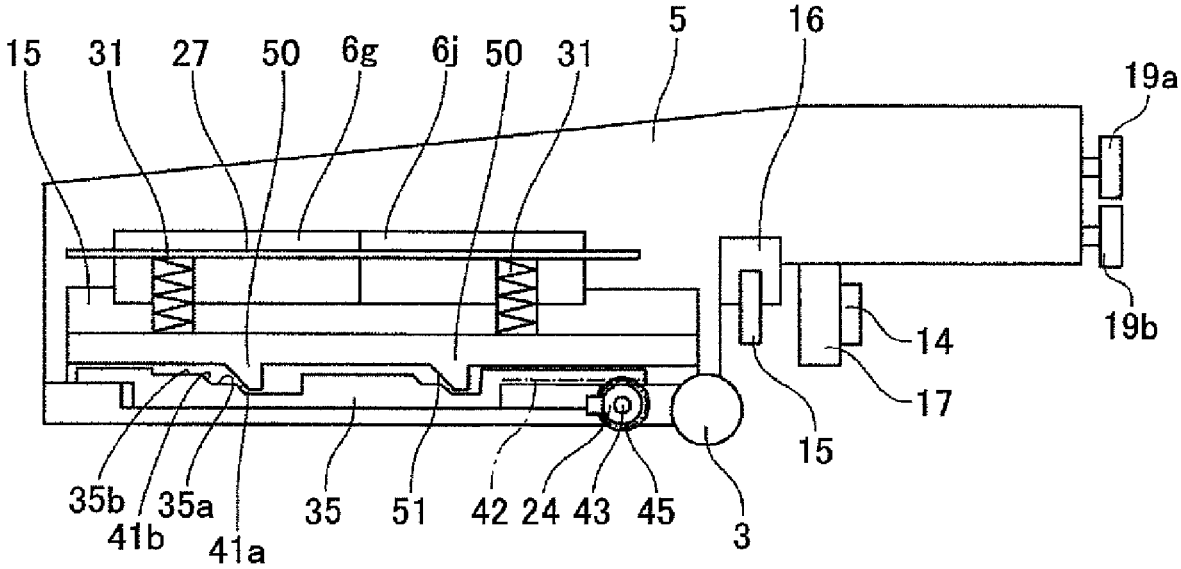
FIG. 12 is a side view for explaining yet another embodiment of the present invention.

Yet another embodiment of the present invention is discussed with reference to FIG. 12. FIG. 12 is a side view for explaining the other embodiment of the present invention.

In this embodiment, as a slide cam, a multistage slide cam 35 having a structure where plural steps of positioning parts 35*a* and 35*b* and cam surfaces 41*a* and 41*b* are formed in a step manner is used. Projection parts 50 of the head base 15 are mounted on the positioning parts 35*a* and 35*b* and the cam surfaces 41*a* and 41*b*. With this structure, an elevating amount of the head base 15 can be adjusted (controlled) in a plural-steps manner. Hence, in thickness of various sheets 10, it is possible to adjust (control) the gap between the recording head 6 and the surface of the sheet 10 to be a proper distance.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that the various changes, substitutions, and alterations could be made hereto without departing from the spirit and scope of the invention.

What is claimed is:

1. An image forming apparatus, comprising:

a base member where a plurality of recording heads is provided, the recording heads being configured to jet liquid drops in an ink drop jetting direction onto a recording medium;

a carriage configured to elevatably support the base member; and an elevating part configured to elevate the base member relative to the carriage, wherein the elevating part is a plurality of slide cam members provided movably in a horizontal direction, wherein the base member is provided on top of the slide cam members, and wherein the base member is pushed toward the carriage by the slide cam members of the elevating part in a direction opposite to the ink drop jetting direction, as the slide cam members move in the horizontal direction.

2. The image forming apparatus as claimed in claim 1, wherein the base member comes directly in contact with a positioning part provided at the carriage in a position where the base member goes most downward.

3. The image forming apparatus as claimed in claim 1, wherein rack gears are provided at the plural slide cam members in a body;

a driving force transmitting part having a shaft having a plurality of gears is provided at the carriage;

the gears of the driving force transmitting part mesh with the rack gears of the slide cam members; and the plural slide cam members are simultaneously moved by applying a driving force to the driving force transmitting part.

4. The image forming apparatus as claimed in claim 3, wherein the driving force transmitting part is connected to a driving force provided in an apparatus main unit when the carriage is in a home position.

5. The image forming apparatus as claimed in claim 1, wherein a positioning part is provided at the slide cam member in a step manner and thereby an elevating amount of the base member can be changed in a plural-steps manner.

6. The image forming apparatus as claimed in claim 1, wherein the slide cam member is provided movably in a scanning direction of the carriage or along a sending direction of the recording medium.

7. The image forming apparatus as claimed in claim 1, wherein the carriage is maintained at a fixed elevation as the slide cam members move in the horizontal direction.

8. The image forming apparatus as claimed in claim 1, wherein the base member includes projection parts having tilted surfaces, the projection parts contacting surfaces of the slide cam members and elevating by an elevation amount as the slide cam members move in the horizontal direction, and wherein the elevation amount of the projection parts as the slide cam members move in the horizontal direction is equal to an amount by which the base member is elevated as the slide cam members move in the horizontal direction.

* * * * *